US011982138B2

(12) United States Patent
Nutakki et al.

(10) Patent No.: US 11,982,138 B2
(45) Date of Patent: May 14, 2024

(54) PULLDOWN APPARATUS

(71) Applicant: Caterpillar Inc., Peoria, IL (US)

(72) Inventors: Satish Nutakki, Chicago, IL (US); Kurt Steven Goslovich, Naperville, IL (US); Ananda Sudhakar Ponnusamy, Naperville, IL (US); Christopher John Demick, Wake Forest, NC (US)

(73) Assignee: Caterpillar Inc., Peoria, IL (US)

( * ) Notice: Subject to any disclaimer, the term of this patent is extended or adjusted under 35 U.S.C. 154(b) by 215 days.

(21) Appl. No.: 17/726,678

(22) Filed: Apr. 22, 2022

(65) Prior Publication Data

US 2023/0340839 A1 Oct. 26, 2023

(51) Int. Cl.
*E21B 19/084* (2006.01)
*E21B 7/02* (2006.01)

(52) U.S. Cl.
CPC ..... *E21B 19/084* (2013.01); *E21B 7/022* (2013.01); *E21B 7/025* (2013.01)

(58) Field of Classification Search
CPC ..... E21B 19/084; E21B 7/022; E21B 7/025
See application file for complete search history.

(56) References Cited

U.S. PATENT DOCUMENTS

| | | | | |
|---|---|---|---|---|
| 3,684,035 | A | 8/1972 | Wills | |
| 3,719,238 | A | 3/1973 | Campbell et al. | |
| 5,310,012 | A | 5/1994 | Cendre et al. | |
| 7,163,069 | B2 | 1/2007 | Bauer et al. | |
| 10,683,712 | B2 * | 6/2020 | Demick | E21B 19/084 |
| 10,718,170 | B2 | 7/2020 | Recker et al. | |
| 11,293,274 | B2 | 4/2022 | Moberg | |
| 2014/0338975 | A1 * | 11/2014 | Hoult | E21B 47/024 175/40 |

FOREIGN PATENT DOCUMENTS

| | | | |
|---|---|---|---|
| CN | 101975029 | B | 12/2012 |
| CN | 110145236 | A | 8/2019 |
| DE | 102016110548 | B4 | 2/2018 |

OTHER PUBLICATIONS

Written Opinion and International Search Report for Int'l. Patent Appln. No. PCT/US2023/016804, dated Jun. 6, 2023 (12 pgs).

* cited by examiner

*Primary Examiner* — Nathaniel C Chukwurah
(74) *Attorney, Agent, or Firm* — von Briesen & Roper, s.c.

(57) ABSTRACT

The pulldown apparatus may comprise a main stage and a secondary stage. The main stage may comprise a cylinder, a main head, a main gland, a piston and a main rod. The cylinder defines a chamber and includes a first end and a second end. The main gland and the piston is disposed in the chamber. The main rod is disposed in the chamber between the piston and the second end. The secondary stage includes a secondary head, a secondary gland, a secondary rod and a flange. The secondary gland is disposed in the chamber. The secondary rod is coupled to the flange. The flange is coupled to the main stage and disposed inside the cylinder between the piston and the secondary rod. The cylinder is slidable over the main rod, the piston and the secondary rod.

20 Claims, 5 Drawing Sheets

PULLDOWN APPARATUS

TECHNICAL FIELD

The present disclosure generally relates to pulldown apparatus for drills, and more particularly, to pulldown apparatus for rotary drills.

BACKGROUND

Pulldown cylinder assemblies are installed on drill machines. Such pulldown cylinder assemblies are often over twenty meters, making them difficult to ship and difficult to store. Material handling of these rods is also challenging.

U.S. Pat. No. 7,163,069, issued Jan. 16, 2007, (the '069 Patent) describes a telescopable boring rod mechanism with at least two mutually displaceable Kelly rods, which are equipped with means for transmitting a torque to the adjacent Kelly rod. At least one of the Kelly rods is constructed from at least two rod segments, which are made from a different material.

SUMMARY OF THE DISCLOSURE

In one aspect of the present disclosure, a pulldown apparatus for a rotary drill machine is disclosed. The pulldown apparatus comprises a main stage and a secondary stage. The main stage may comprise a cylinder, a main head, a main gland, a piston and a main rod. The cylinder defines a chamber that extends lengthwise through the cylinder. The cylinder includes a first end and a second end. The main head may be disposed on the second end of the cylinder and includes an aperture extending therethrough. The main gland is disposed in the chamber and is adjacent to the main head. The piston is disposed in the chamber adjacent to the first end. The main rod is disposed in the chamber between the piston and the second end. The main rod has a fluid channel that extends lengthwise therethrough. The secondary stage includes a secondary head, a secondary gland, a secondary rod and a flange. The secondary head is disposed on the first end of the cylinder. The secondary head includes an opening extending therethrough. The secondary gland is disposed in the chamber and is adjacent to the secondary head. The secondary rod is disposed in the opening and is coupled to a flange. The secondary rod includes a fluid passageway that extends lengthwise through. The flange is coupled to the main stage and disposed inside the cylinder between the piston and the secondary rod. The cylinder is slidable over the main rod, the piston and the secondary rod.

In another aspect of the disclosure, a method of assembling a pulldown apparatus, which includes a main stage and a secondary stage, is disclosed. The main stage is configured to receive at least a portion of the secondary stage. The main stage includes a cylinder, a main head, a main gland, a piston and a main rod. The cylinder defines a chamber that extends lengthwise through the cylinder. The cylinder includes a first end and a second end. The main head is disposed on the second end of the cylinder. The main head includes an aperture that extends therethrough. The main gland is disposed in the chamber and is adjacent to the main head. The piston is disposed in the chamber adjacent to the first end. The main rod is disposed in the chamber between the piston and the second end. The main rod has a fluid channel that extends lengthwise through the main rod. The secondary stage includes a secondary head, a secondary gland, a secondary rod and a flange. The secondary head includes an opening extending therethrough. The secondary gland adjacent to the secondary head. The secondary rod coupled to the flange. The secondary rod including a fluid passageway that extends lengthwise through the secondary rod. The secondary rod extends through the secondary gland and secondary head. The method may comprise: disposing the flange in the chamber between the piston and the first end of the cylinder; coupling the flange to the main stage, wherein after the flange is coupled to the main stage, the cylinder is slidable over the flange and the secondary rod; disposing the secondary gland in the chamber; and coupling the secondary head to the first end of the cylinder. Wherein the secondary rod is disposed in the opening. Wherein the cylinder is slidable over the main rod, the piston and the secondary rod.

In yet another aspect of the disclosure, a pulldown apparatus disposed on a rotary drill machine is disclosed. The rotary drill machine includes a deck frame and a drilling mast. The drilling mast includes a mast frame and a crown. The mast frame includes a first mast end and a second mast end. The second mast end of the mast frame is mounted on the deck frame. The crown is coupled to the mast frame adjacent to the first mast end. The pulldown apparatus comprises a main stage and a secondary stage. The main stage includes a cylinder, a main head, a main gland, a piston, and a main rod. The cylinder defines a chamber that extends lengthwise therethrough. The cylinder includes a first end and a second end. The main head is disposed on the second end of the cylinder. The main head includes an aperture extending therethrough. The main gland is disposed in the chamber and is adjacent to the main head. The piston is disposed in the chamber adjacent to the first end. The main rod is disposed in the chamber between the piston and the second end. The main rod includes a fluid channel that extends lengthwise therethrough. The secondary stage includes a secondary head, a secondary gland, a secondary rod, and a flange. The secondary head is disposed on the first end of the cylinder. The secondary head includes an opening extending therethrough. The secondary gland is disposed in the chamber and is adjacent to the secondary head. The secondary rod is disposed in the opening and is coupled to the flange. The secondary rod includes a fluid passageway that extends lengthwise therethrough. The flange is coupled to the main stage and is disposed inside the cylinder between the piston and the secondary rod. Wherein the cylinder is slidable over the main rod, the piston and the secondary rod. Wherein the main rod is coupled to the deck frame, and the secondary rod is coupled to the crown.

DETAILED DESCRIPTION

Figure 1:
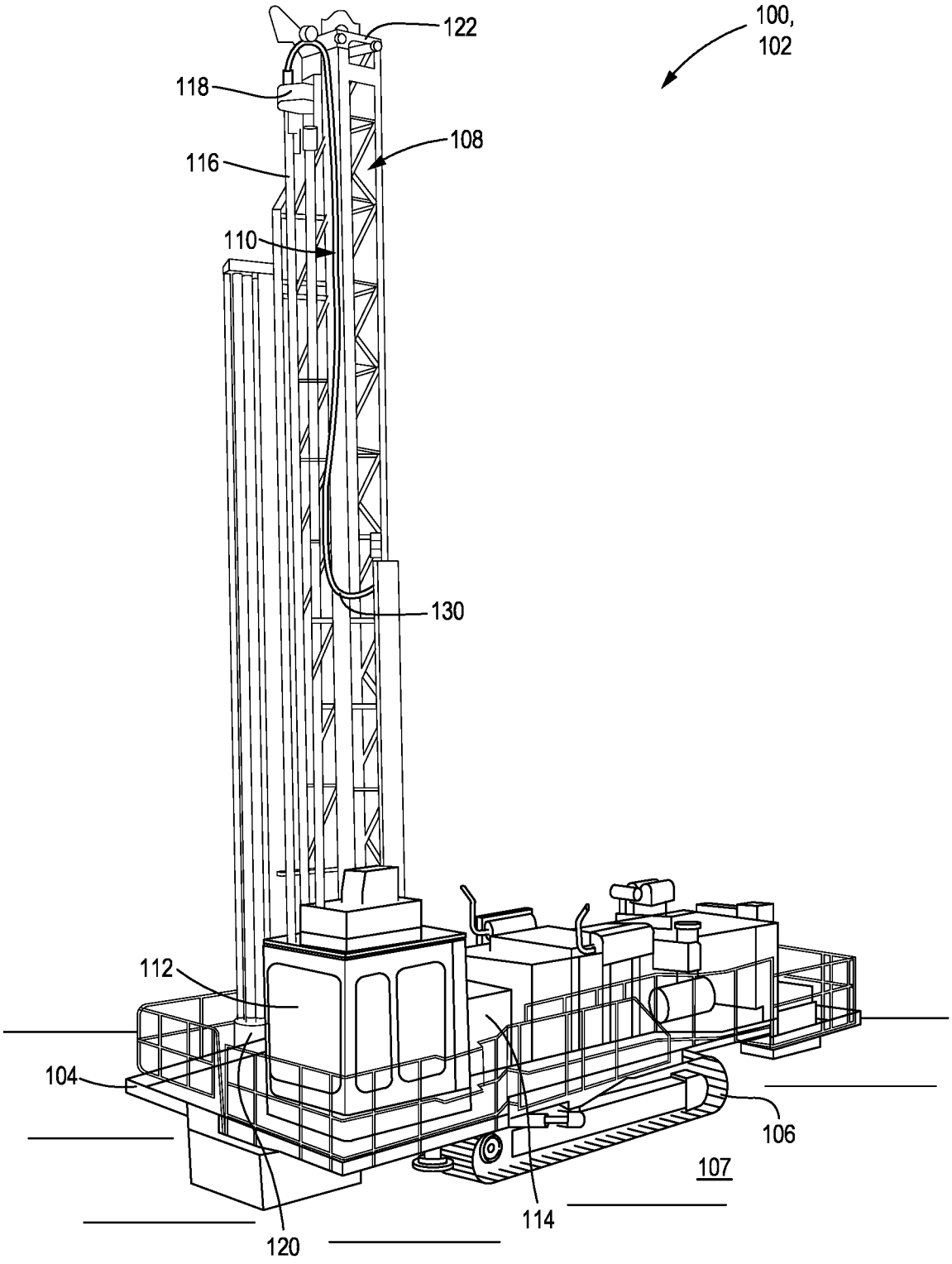
FIG. 1 is a perspective view of an exemplary rotary drill machine including a pulldown apparatus, according to the present disclosure.

Reference will now be made in detail to specific embodiments or features, examples of which are illustrated in the accompanying drawings. Generally, corresponding reference numbers will be used throughout the drawings to refer to the same or corresponding parts, unless otherwise specified. FIG. 1 illustrates one example of a machine 100 that incorporates the features of the present disclosure. The exemplary machine 100 may be a rotary drill machine 102 such as a blast hole drill machine. While the following detailed description and drawings are made with reference to the exemplary rotary drill machine 102, the teachings of this disclosure may be employed on other like machines 100.

Figure 2:
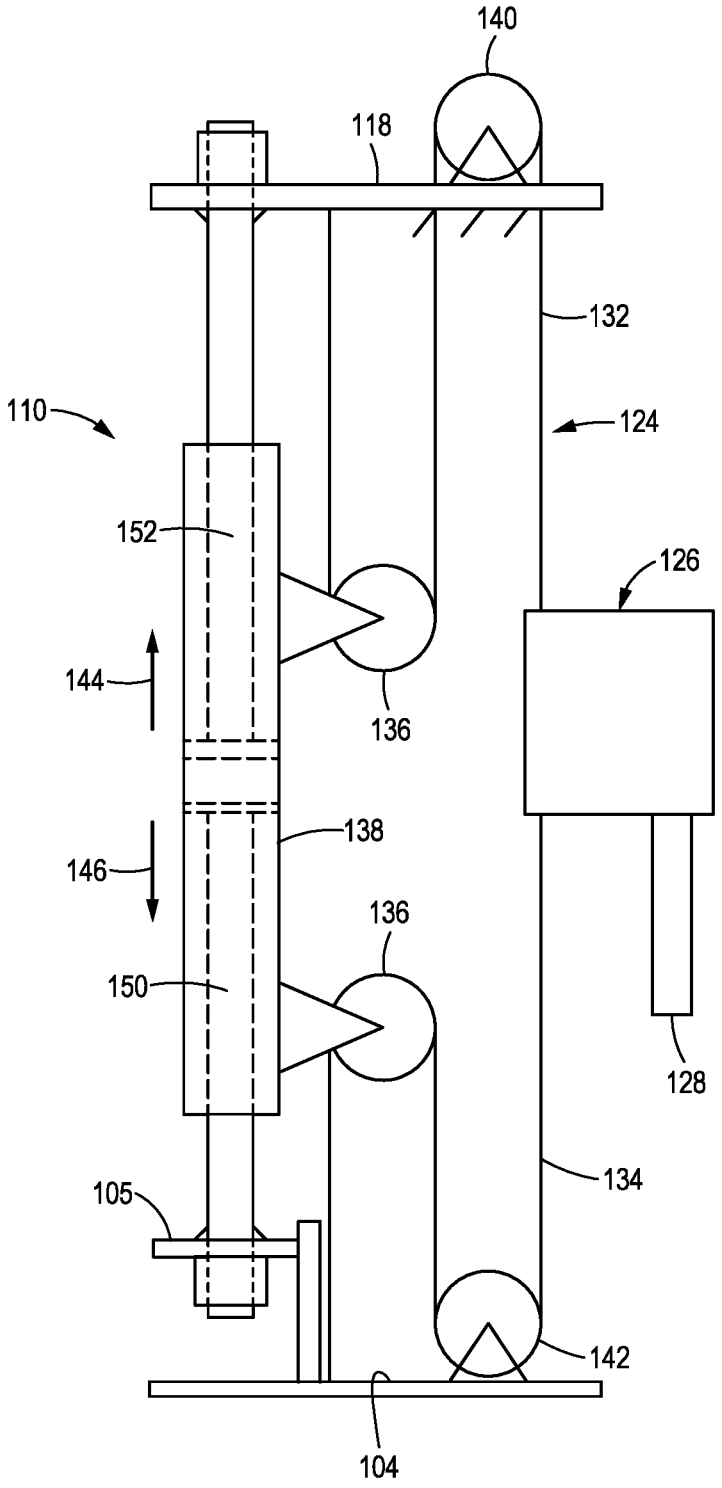
FIG. 2 is diagrammatic view of an embodiment of the pulldown apparatus, drill head and drill bit of the exemplary machine of FIG. 1.

The exemplary rotary drill machine 102 may include a deck frame 104 supported on the ground by ground engaging members 106 such as crawler tracks or the like. In an embodiment, the deck frame 104 may include a mounting member 105 (FIG. 2). The ground engaging members 106 (FIG. 1) are configured to move the rotary drilling machine 102 across the surface 107 and to maneuver the rotary drilling machine 102 on the surface 107 to a desired location for a drilling operation. The rotary drill machine 102 further includes a drilling mast 108 and a pulldown apparatus 110, each disposed on the deck frame 104. An operator cab 112 may also be disposed on the deck frame 104. The deck frame 104 may further support a power source 114 (e.g., an engine) and other equipment (not shown, e.g., motors, batteries, pumps, air compressors and/or the like) to power and operate the rotary drill machine 102.

The drilling mast 108 may include a mast frame 116 and a crown 118. The mast frame 116 has a first mast end 120 and a second mast end 122 opposite to the first mast end 120. The first mast end 120 is disposed on the deck frame 104. The crown 118 is coupled to the mast frame 116 adjacent to the second mast end 122. Turning now to FIG. 2, the drilling mast 108 is configured to support a cable feed system 124 (shown schematically in FIG. 2), a drill head 126 coupled to the cable feed system 124, a drill bit 128 coupled to the drill head 126, the pulldown apparatus 110, and a hydraulic line system 130 (see FIG. 1) fluidly connected to a fluid channel 178 and a fluid passageway 204 of the pulldown apparatus 110.

The cable feed system 124 may include a pullback cable 132, a pulldown cable 134, one or more pulldown pulleys 136 coupled to a cylinder 138 of the pulldown apparatus 110, one or more crown pulleys 140 coupled to the crown 118 or to the second mast end 122, and one or more floor pulleys 142 coupled to the deck frame 104. A drill motor (not shown) may be operationally coupled to the cable feed system 124 and configured to slide the cylinder 138 of the pulldown apparatus 110 in a first direction 144 and a second direction 146 across a piston 148 and at least a portion of the main rod 150 and at least a portion of the secondary rod 152. The first direction 144 is opposite to the second direction 146. In operation, movement of the cylinder 138 in the first direction 144 will, via the cable feed system 124, drive the drill bit 128 toward and/or into the surface 107 (FIG. 1) and movement of the cylinder 138 in the second direction 146 will draw, via the cable feed system 124, the drill bit 128 upward and/or out of the surface 107 (FIG. 1).

Figure 3:
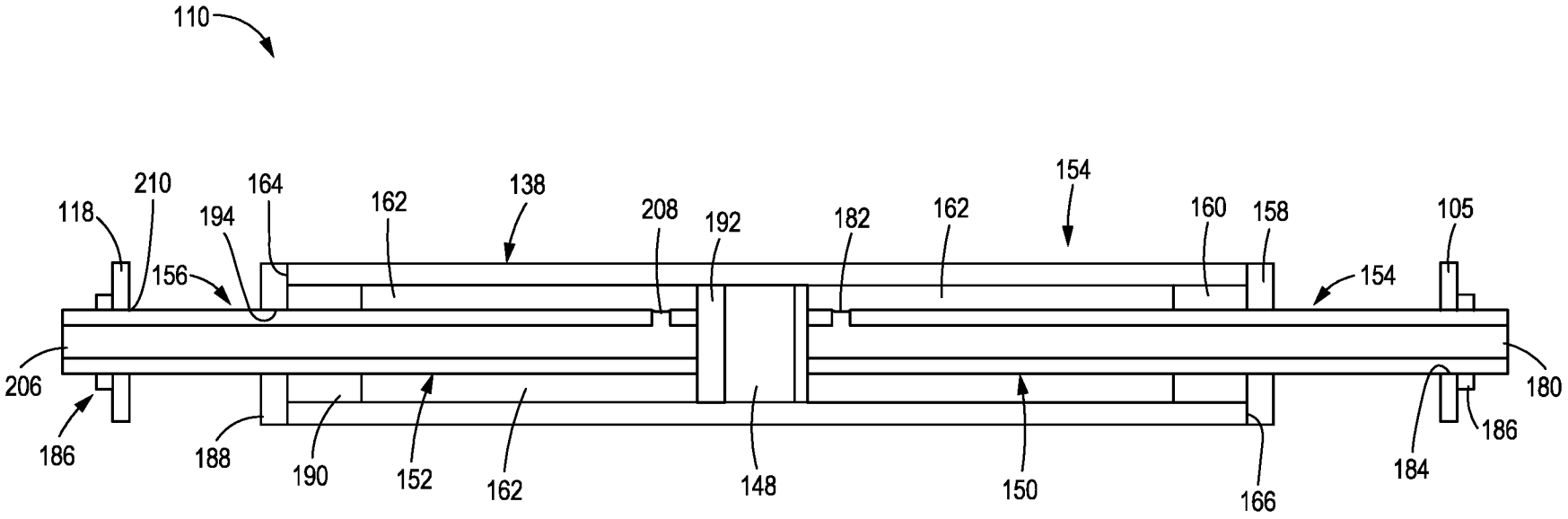
FIG. 3 is a diagrammatic view of a cross-section of an embodiment of the pulldown apparatus of FIG. 1.

FIG. 3 illustrates a diagrammatic view of the pulldown apparatus 110 coupled to the mounting member 105 of deck frame 104 and coupled to the crown 118. The pulldown apparatus 110 comprises a main stage 154 (best seen in FIG. 4) and a secondary stage 156 (best seen in FIG. 5).

Figure 4:
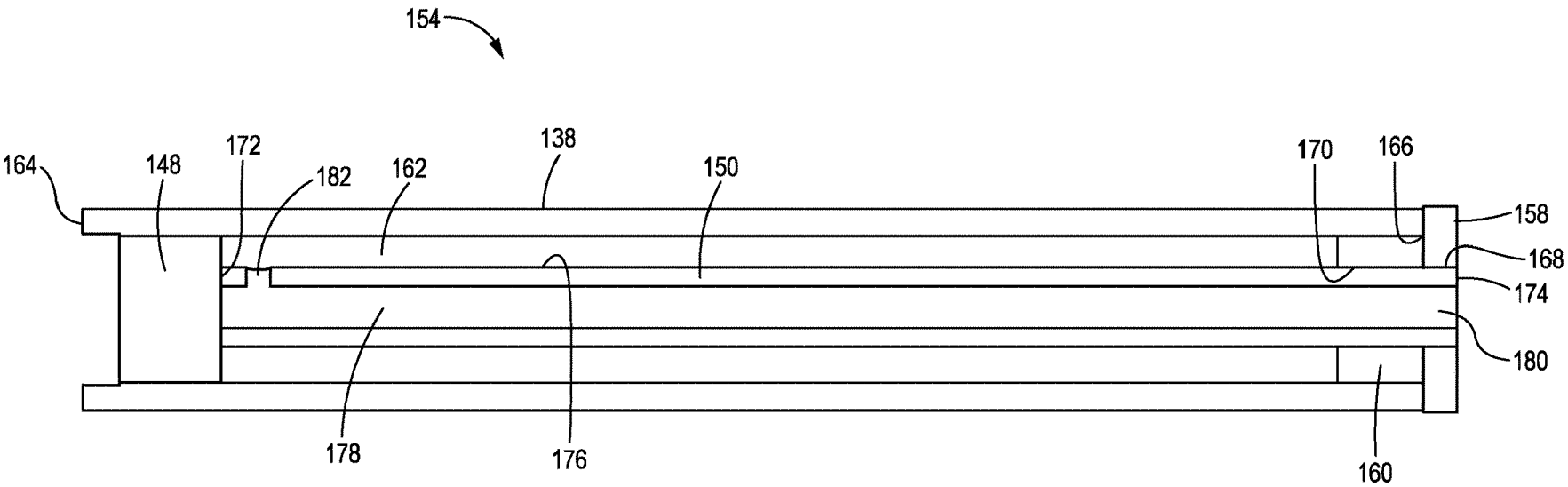
FIG. 4 is a diagrammatic view of a cross section of the main stage of the exemplary pulldown apparatus of FIG. 3.

As shown in FIGS. 3-4, the main stage 154 includes a cylinder 138, a main head 158, a main gland 160, a piston 148 and a main rod 150.

Turning now to FIG. 4, the cylinder 138 defines a chamber 162 that extends lengthwise through the cylinder 138. The cylinder 138 includes a first end 164 and a second end 166 opposite to the first end 164.

The main head 158 is disposed adjacent to or on the second end 166 of the cylinder 138 and includes an aperture 168 extending therethrough. The aperture 168 is configured to slidingly receive the main rod 150. In an embodiment, the main head 158 is coupled to the second end 166 of the cylinder 138.

The main gland 160 is disposed in the chamber 162 and may be adjacent or directly adjacent to the main head 158. The main gland 160 may be coupled to the main head 158. The main gland 160 includes a main bore 170 extending therethrough. The main bore 170 is configured to slidingly receive the main rod 150.

The piston 148 is disposed in the chamber 162 adjacent to the first end 164 of the cylinder 138. In an embodiment, the piston 148 may be stationary and disposed between the main rod 150 and a secondary rod 152 (FIG. 3) of the secondary stage 156.

The main rod 150 is disposed in the chamber 162 between the piston 148 and the second end 166 of the cylinder 138. The main rod 150 includes a first main end 172 (FIG. 4), a second main end 174 opposite to the first main end 172, and a main sidewall 176 extending from the first main end 172 to the second main end 174. The main rod 150 further includes a fluid channel 178, a main input port 180 and a main output port 182. The fluid channel 178 extends lengthwise through the main rod 150 and between the first main end 172 and the second main end 174. The main input port 180 may be disposed at the second main end 174. The main output port 182 may be disposed in the main sidewall 176. The main input port 180 is fluidly connected to the hydraulic line system 130 and to the fluid channel 178. The main output port 182 is fluidly connected to the hydraulic line system 130 and to the fluid channel 178. In an embodiment, the main output port 182 may be disposed in the main sidewall 176 between the piston 148 and the main gland 160. The main rod 150 may be coupled to the mounting member 105 (FIG. 3) of the deck frame 104 (FIG. 1). In some embodiments, the main rod 150 (FIG. 3) may extend through an orifice 184 in the mounting member 105 of the deck frame 104 (FIG. 1). The main rod 150 (FIG. 3) may be secured by an appropriate fastener (186) or securing system.

Figure 5:
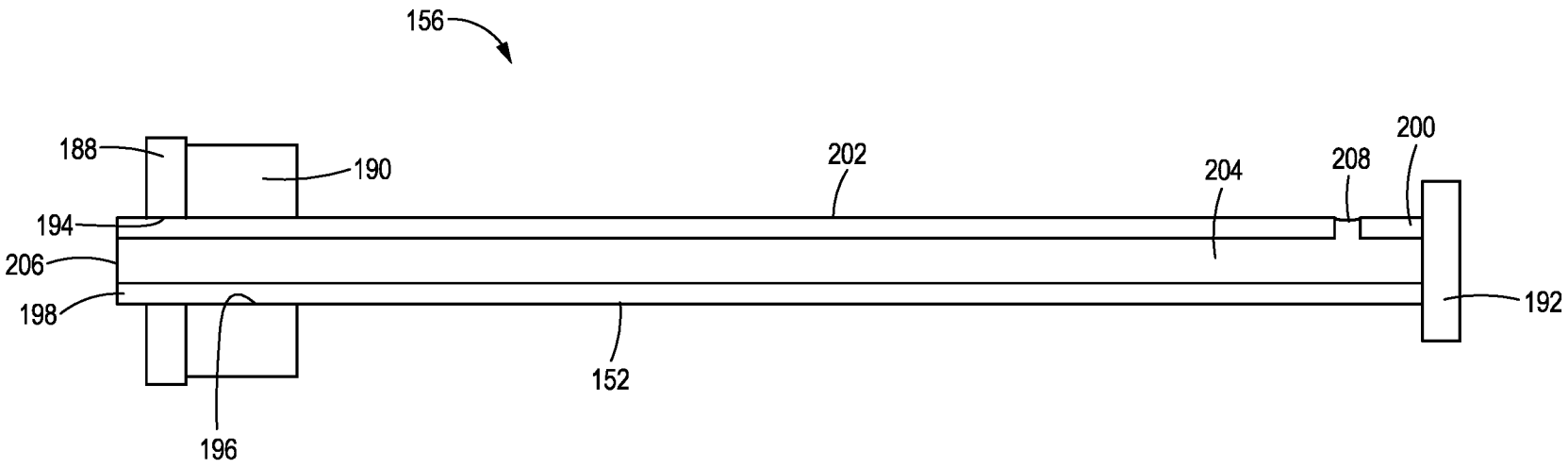
FIG. 5 is a diagrammatic view of a cross section of the secondary stage of the exemplary pulldown apparatus of FIG. 3.

As shown in FIGS. 3 and 5, the secondary stage includes a secondary head 188, a secondary gland 190, a secondary rod 152 and a flange 192.

As shown in FIG. 3. the secondary head 188 is disposed on the first end 164 of the cylinder 138 and includes an opening 194 extending through the secondary head 188. The opening 194 is configured to slidingly receive the secondary rod 152.

The secondary gland 190 is disposed in the chamber 162 (FIG. 3) and may be adjacent or directly adjacent to the secondary head 188. In an embodiment, the secondary gland 190 may be coupled to the secondary head 188. The secondary gland 190 includes a secondary bore 196 (best seen in FIG. 5) extending therethrough. The secondary bore 196 is configured to slidingly receive the secondary rod 152.

The secondary rod 152 is disposed in the opening 194 and in the secondary bore 196 and is coupled to the flange 192. In operation of the pulldown apparatus 110, at least a portion of the secondary rod 152 (see FIG. 3) is also disposed the chamber 162 of the cylinder 138 between the flange 192 and the first end 164 of the cylinder 138. The secondary rod 152 (FIG. 5) includes a first secondary rod end 198, a second secondary rod end 200 opposite to the first secondary rod end 198, and a secondary sidewall 202 extending from the first secondary rod end 198 to the second secondary rod end 200. The secondary rod 152 further includes a fluid passageway 204, a secondary input port 206 and a secondary output port 208. The fluid passageway 204 extends lengthwise through the secondary rod 152 and between the first secondary rod end 198 and the second secondary rod end 200. The secondary input port 206 may be disposed at or adjacent to the first secondary rod end 198. The secondary output port 208 may be disposed in the secondary sidewall 202. The secondary input port 206 is fluidly connected to the hydraulic line system 130 and to the fluid passageway 204. The secondary output port 208 is fluidly connected to the hydraulic line system 130 and to the fluid passageway 204. In an embodiment, the secondary output port 208 may be disposed in the secondary sidewall 202 between the piston 148 (FIG. 3) and the secondary gland 190. In an embodiment, the secondary rod 152 may be coupled to or secured to the crown 118. In some embodiments, the secondary rod 152 may extend through the crown 118 via a crown aperture 210 that extends through the crown 118, and may be secured to the crown 118 with a fastener 186 or other appropriate securing system.

As shown in FIG. 3, the flange 192 is coupled to the main stage 154 and disposed inside the cylinder 138 between the piston 148 and the secondary rod 152. In some embodiments, the flange 192 may be coupled to or adjacent to the piston 148.

The cylinder 138 is configured to be slidable over the main rod 150, the piston 148 and the secondary rod 152.

Also disclosed is a method of assembling the pulldown apparatus 110, the method comprising: disposing the flange 192 in the chamber 162 between the piston 148 and the first end 164 of the cylinder 138; coupling the flange 192 to the main stage 154, wherein, after the flange 192 is coupled to the main stage 154, the cylinder 138 is slidable over the flange 192 and the secondary rod 152; disposing the secondary gland 190 in the chamber 162; and coupling the secondary head 188 to the first end 164 of the cylinder 138, the secondary head 188 including an opening 194 extending therethrough, wherein the secondary rod 152 is disposed in the opening 194, the secondary rod 152 including a fluid passageway 204 that extends lengthwise through, wherein the cylinder 138 is slidable over the main rod 150, the piston 148 and the secondary rod 152.

INDUSTRIAL APPLICABILITY

In general, the foregoing disclosure finds utility in machines 100, especially rotary drill machines. Disclosed herein is pulldown apparatus 110 that may be efficiently transported, handled and/or stored until needed. To assemble, the flange 192 is disposed in the chamber 162 between the piston 148 and the first end 164 of the cylinder 138. The flange 192 may then be coupled to the main stage 154, wherein after the flange 192 is coupled to the main stage 154, the cylinder 138 is slidable over the flange 192 and the secondary rod 152. The secondary gland 190 may be disposed in the chamber 162, and the secondary head 188 coupled to the first end 164 of the cylinder 138. The secondary head 188 includes an opening 194 extending therethrough, wherein the secondary rod 152 is disposed in the opening 194. The secondary rod 152 includes a fluid passageway 204 that extends lengthwise through, wherein the cylinder 138 is slidable over the main rod 150, the piston 148 and the secondary rod 152.

In operation, the drill motor (not shown) that is operationally coupled to the cable feed system 124 slides the cylinder 138 of the pulldown apparatus 110 in a first direction 144 (toward the crown 118) across the piston 148 and at least a portion of the main rod 150 and at least a portion of the secondary rod 152 via the cable feed system 124. The movement of the cylinder 138 in the first direction 144 will, via the cable feed system 124, drive the drill bit 128 toward and/or into the surface 107 (FIG. 1). Movement of the cylinder 138 in the second direction 146 will draw, via the cable feed system 124, the drill bit 128 upward and/or out of the surface 107 (FIG. 1). During operation, the hydraulic line system 130 provides an appropriate flow of hydraulic fluid to the main input port 180 and/or secondary input port 206, as is known in the art. Fluid exits the fluid channel 178 of the main rod 150 back to the hydraulic line system 130 via the main output port 182. Similarly, fluid exits the fluid passageway 204 of the secondary rod 152 back to the hydraulic line system 130 via the secondary output port 208, as is known in the art.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A pulldown apparatus for a rotary drill machine, the pulldown apparatus comprising:

a main stage including:

a cylinder that defines a chamber extending lengthwise therethrough, the cylinder including a first end and a second end;

a main head disposed on the second end of the cylinder, the main head including an aperture extending therethrough;

a main gland disposed in the chamber and adjacent to the main head;

a piston disposed in the chamber adjacent to the first end; and a main rod disposed in the chamber between the piston and the second end, the main rod having a fluid channel that extends lengthwise therethrough; and a secondary stage including:

a secondary head disposed on the first end of the cylinder, the secondary head including an opening extending therethrough;

a secondary gland disposed in the chamber and adjacent to the secondary head;

a secondary rod disposed in the opening and coupled to a flange, the secondary rod including a fluid passageway that extends lengthwise therethrough; and the flange coupled to the main stage and disposed inside the cylinder between the piston and the secondary rod, wherein the cylinder is slidable over the main rod, the piston and the secondary rod.

2. The pulldown apparatus of claim 1, wherein the flange is releasably coupled to the main stage.

3. The pulldown apparatus of claim 1, in which the main rod is configured to be mounted on a deck frame of the machine.

4. The pulldown apparatus of claim 3, wherein the secondary rod is configured to be mounted to a crown of a drilling mast disposed on the machine.

5. The pulldown apparatus of claim 1, wherein the main gland is slidable over the main rod and the secondary gland is slidable over the secondary rod.

6. The pulldown apparatus of claim 1, wherein, the cylinder is slidable over the flange.

7. The pulldown apparatus of claim 1, wherein the main head is slidable over the main rod and the secondary head is slidable over the secondary rod.

8. The pulldown apparatus of claim 1, wherein the piston is stationary inside the cylinder.

9. A method of assembling a pulldown apparatus that includes a main stage and a secondary stage, the main stage configured to receive at least a portion of the secondary stage, the main stage including a cylinder, a main head, a main gland, a piston and a main rod, the cylinder defining a chamber that extends lengthwise through the cylinder, the cylinder including a first end and a second end, the main head disposed on the second end of the cylinder, the main head including an aperture that extends therethrough, the main gland disposed in the chamber and adjacent to the main head, the piston disposed in the chamber adjacent to the first end, the main rod disposed in the chamber between the piston and the second end, the main rod having a fluid channel that extends lengthwise through the main rod, the secondary stage including a secondary head, a secondary gland, a secondary rod and a flange, the secondary gland adjacent to the secondary head, the secondary rod coupled to the flange, the secondary rod including a fluid passageway that extends lengthwise through, the secondary rod extending through the secondary gland and secondary head, the method comprising:

disposing the flange in the chamber between the piston and the first end of the cylinder;

coupling the flange to the main stage, wherein after the flange is coupled to the main stage, the cylinder is slidable over the flange and the secondary rod;

disposing the secondary gland in the chamber; and coupling the secondary head to the first end of the cylinder, the secondary head including an opening extending therethrough, wherein the secondary rod is disposed in the opening, wherein the cylinder is slidable over the main rod, the piston and the secondary rod.

10. The method according to claim 9, wherein the piston is stationary.

11. The method according to claim 9, coupling the main rod to a deck floor of a rotary drill machine, and coupling the secondary rod to a crown of a drilling mast of the rotary drill machine.

12. The method according to claim 9, wherein the flange is releasably coupled to the main stage.

13. The method according to claim 9, wherein the flange is releasably coupled to the piston of the main stage.

14. A pulldown apparatus disposed on a rotary drill machine, the rotary drill machine including a deck frame and a drilling mast, the drilling mast including a mast frame and a crown, the mast frame including a first mast end and a second mast end, the second mast end of the mast frame mounted on the deck frame, the crown coupled to the mast frame adjacent to the first mast end, the pulldown apparatus comprising:

a main stage including:

a cylinder that defines a chamber extending lengthwise therethrough, the cylinder including a first end and a second end;

a main head disposed on the second end of the cylinder, the main head including an aperture extending therethrough;

a main gland disposed in the chamber and adjacent to the main head;

a piston disposed in the chamber adjacent to the first end; and a main rod disposed in the chamber between the piston and the second end, the main rod including a fluid channel that extends lengthwise therethrough; and a secondary stage including:

a secondary head disposed on the first end of the cylinder, the secondary head including an opening extending therethrough;

a secondary gland disposed in the chamber and adjacent to the secondary head;

a secondary rod disposed in the opening and coupled to a flange, the secondary rod including a fluid passageway that extends lengthwise therethrough; and the flange coupled to the main stage and disposed inside the cylinder between the piston and the secondary rod, wherein the cylinder is slidable over the main rod, the piston and the secondary rod, wherein the main rod is coupled to the deck frame, and the secondary rod is coupled to the crown.

15. The pulldown apparatus of claim 14, wherein the piston is stationary and the cylinder is slidable over the piston.

16. The pulldown apparatus of claim 14, wherein the main head is coupled to the second end of the cylinder.

17. The pulldown apparatus of claim 14, wherein the main gland includes a main bore therethrough, wherein the main rod is disposed in the main bore.

18. The pulldown apparatus of claim 14, in which the main rod further includes a first main end, a second main end opposite to the first main end, a main sidewall extending between the first main end and the second main end, a main input port and a main output port, the main input port disposed on the second main end and fluidly connected to the fluid channel, the main output port disposed on the main sidewall between the main gland and the piston.

19. The pulldown apparatus of claim 14, in which the secondary rod further includes a first secondary rod end, a second secondary rod end disposed opposite to the first secondary rod end, a secondary sidewall disposed extending between the first secondary rod end and the second secondary rod end, a secondary input port and a secondary output port, the secondary input port disposed on the first secondary rod end adjacent to the crown and is fluidly connected to the fluid passageway, the secondary output port disposed in the secondary sidewall between the secondary gland and the piston.

20. The pulldown apparatus of claim 14, wherein the secondary gland includes a secondary bore therethrough, wherein the secondary rod is disposed in the secondary bore.

* * * * *